United States Patent [19]

Simmons

[11] 4,363,272

[45] Dec. 14, 1982

[54] DEVICE FOR AN ELECTRIC IGNITER

[75] Inventor: Björn Simmons, Karlskoga, Sweden

[73] Assignee: Aktiebolaget Bofors, Bofors, Sweden

[21] Appl. No.: 101,400

[22] Filed: Dec. 7, 1979

Related U.S. Application Data

[62] Division of Ser. No. 895,406, Apr. 10, 1978, Pat. No. 4,239,005.

[30] Foreign Application Priority Data

Apr. 19, 1977 [SE] Sweden ..... 7704436

[51] Int. Cl.[3] ..... F42C 11/00

[52] U.S. Cl. ..... 102/202.13; 102/202.9; 102/202.14; 102/265

[58] Field of Search ..... 102/202.13, 265, 270, 102/472, 206, 202, 203, 202.7, 202.9, 202.5, 275.3, 277.1, 277.2, 202.14; 89/1 C

[56] References Cited

U.S. PATENT DOCUMENTS 2,141,827 12/1938 Schlumberger ..... 89/1 C
3,541,961 11/1970 Larson ..... 102/202.6
3,759,183 9/1973 Apstein ..... 102/206

OTHER PUBLICATIONS

"Military Explosives", Dept. of Army, TM91910, Apr. 1955, pp. 93–98, 177–182.

*Primary Examiner*—Harold J. Tudor
*Attorney, Agent, or Firm*—Pollock, Vande Sande & Priddy

[57] ABSTRACT

An electric ignition device having a pyrotechnical delay portion and a pyrotechnical ignition portion enclosed in a container. A first conducting ignition element is supported adjacent the delay portion and a second conducting ignition element is supported adjacent the ignition portion. The elements are connected in series to receive a voltage input from an external source. The first element is dimensioned so that it will heat to an ignition temperature in response to a particular low voltage level and will conduct when a higher second voltage level is applied. The second element will heat to an ignition temperature only when the second voltage level is applied. If the first voltage level is applied, the first element heats and ignites the delay portion and the delay portion burns at a particular rate for a characteristic delay interval and then ignites the ignition portion. If the second voltage is applied, the second element heats to rapidly ignite the ignition portion.

9 Claims, 8 Drawing Figures

A—A

B—B

DEVICE FOR AN ELECTRIC IGNITER

This is a division of application Ser. No. 895,406, filed Apr. 10, 1978, now U.S. Pat. No. 4,239,005.

The present invention relates to a device for an electric igniter which comprises a pyrotechnical initiating composition, a delay composition and electric circuits having filaments or ignition corresponding elements which heat to ignition temperatures when power is connected to the electric circuits.

TECHNICAL FIELD

In principle, the apparatus of the invention is a further improvement of the so-called bridge-wire igniter. The improved igniter overcomes problems that occur when an electric ignition cap (blasting cap) functions as a modular unit. The improved igniter has universal applicability for achieving longer or shorter ignition times for rocket motor ignition system or for bursting charges in shells or the like.

In accordance with the invention, a new electric ignition cap is provided wherein at least one pyrotechnical delay composition is utilized with corresponding ignition elements to ignite an initiating composition with at least two different ignition times. The ignition times may be determined by selecting a particular burning time for the delay composition and by selecting the elements to ignite either the delay composition or the initiating composition.

In embodiments of the invention it will be possible to construct the electric ignition or blasting cap so that the delay times can be chosen within an extremely short time interval, from nanoseconds or microseconds up to several seconds.

In addition to having a very safe and reliable operation, the new electric cap will also have a comparatively simple construction and, extremely small external dimensions as well. The small dimensions make it possible, if desired, to substitute a common cap working with only one delaying time with the new cap working with at least two delaying times without requiring a redesign of a whole ignition system. The new cap can also be made very sensitive, thereby allowing simpler power sources to be used.

The electric cap, according to the invention, has mutually separated ignition elements and at least one pyrotechnical delay composition for igniting an initiating composition at two different initiation or delay times. The different delay times may be selected by means of different pulse features, for example either high or low power levels applied to the elements or different connection paths for the power.

BRIEF DESCRIPTION OF THE DRAWINGS

Proposed embodiments of the electric igniter according to the invention will be described in the following, with reference to the accompanying drawings, in which FIG. 1 in a vertical section shows the electric ignition cap in a first embodiment made for single-pole connection.

BEST MODE FOR CARRYING OUT THE INVENTION

In the Figures, parts corresponding to each other have been given the same reference designations, supplemented with prime signs, double prime signs, triple prime signs, etc.

Figure 1:
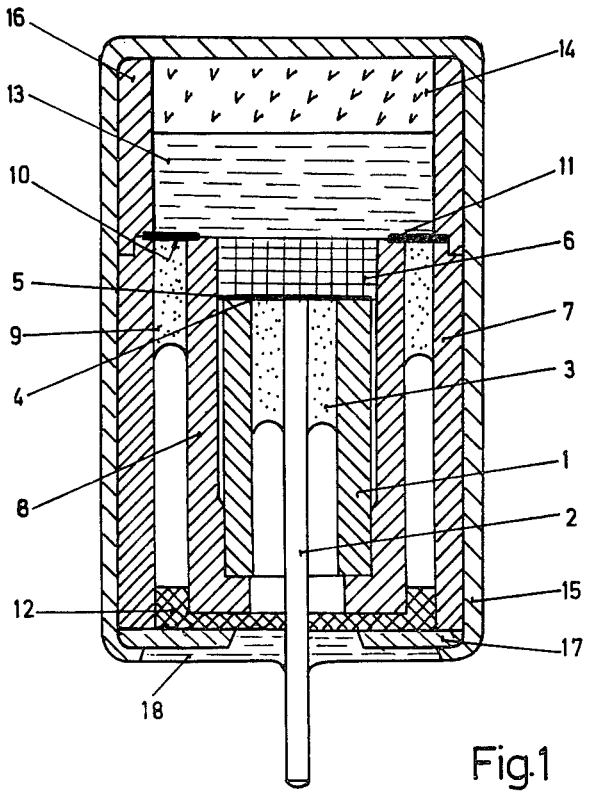

In FIG. 1, a first unit made of electrically conducting material, for instance chromium steel or similar material, is indicated by the numeral 1. The first unit is made in the form of a sleeve, and coaxially inside the unit a rodshaped second unit 2 is arranged, which is also made of an electrically conducting material such as an iron or nickel alloy or the like. The units are fixed in relation to each other by means of an electrically insulating body 3 made substantially of glass or porcelain. The three end surfaces of units 1 and 2 and the body 3 define a common end surface 4, at which is arranged at least one first element 5 in the form of a bridging element, electrically connecting the units 1 and 2. In the present embodiment has been achieved by means of a metal layer which the connection is applied directly on the surface by means of vacuum evaporization, a technique which is known in itself. The metal layer may consist of a very thin (e.g. $2 \cdot 10^{-8}$ m) layer of chromium adjacent the surface and on top of the chromium layer, a very thin (e.g. $10^{-7}$ m) layer of gold. The layer of chromium guarantees very good adhesion to the units and the body, while the gold layer or the like guarantees good electrically conducting properties and corrosion resistance. Before the layers are applied, the surface should be ground and polished very carefully, and the connection between the units 1 and 2 and the insulating body 3 should also be made with great mechanical strength and tightness (helium-tight) to ensure that there will be no interruption in the thin layers of metal. Great mechanical strength is obtained when the glass body is melted in between the metal units, which are chosen so that a good wetting effect will be obtained. In certain cases, the good wetting effect can be obtained by providing appropriate thicknesses for the oxide layers which are formed. Further, the materials in the units 1 and 2 and the body 3 have substantially the same coefficients of expansion, so that the electric ignition or blasting cap will function within the temperature range in which ammunition of the type contemplated is used. The metal layer is cut up with a laser or the like, to form distinct bar-shaped elements with dimensions that can easily be determined since the dimensions of the bars can be determined, and since there are no welds or soldered connections for the elements, the elements may be made with different degrees of sensitivity, that is their ignition temperatures may be predetermined in a simple manner for different values of connected capacitance or applied voltage. However, the invention may also function with conventional filaments that may be employed to replace the described elements. Corresponding connections may also be obtained by utilizing baked-in graphite powder or the like in the initiating composition and delay composition, to form conducting composition igniters.

A first pyrotechnical delay composition 6 is pressed with a comparatively high pressure, for example from 20–100 MPa against the surface 4 and the metal layers and cut-out bar elements. The delay composition 6 may be ignited by means of a first element 5 when a capacitance voltage or other voltage of a certain size is applied to the element to cause the element to heat to the ignition temperature. The size of the applied capacitance voltage or other voltage is identified hereafter as the first power level. The delay composition 6 is of a known kind which burns gaslessly and which comprises oxidation and reducing agents in proportions which permit combustion.

A third unit 7, made of electrically conducting material, such as chromium steel or the like, and a fourth unit 8, of for example iron-nickel, are connected in the manner described for the first and second units. Thus, both the third unit and the fourth unit are shaped in the form of a sleeve. The fourth unit 8 encases the first unit 1, to which it is also galvanically connected at one end. The third and the fourth units are separated from each other by means of a second electrically insulating body 9 made of glass or porcelain in the manner described for the first insulating body 3. The three end surfaces of units 7 and 8 and the insulating body 9 define a second common end surface 10 which corresponds to the first common end surface 4. The surface 10 carries metal layers which correspond to those on the surface 4, and two bar-shaped elements 11 are cut out of the layers on the surface 10 by means of a laser or the like, the two bars then connecting the units 7 and 8. The number of elements 11 can, of course, be varied, for example one or more elements may be employed. Thus, the invention is not limited to two elements. The units 7 and 8 are held together at their ends via a supporting part 12 that is made of electrically insulating material. The first unit is supported in the fourth unit in both the radial and the axial directions, the fourth unit then being made with a folded-in flange, for fixation in the axial direction. At the flange, the unit 8 has an aperture running through it, through which the unit 2 extends. The fourth unit extends longer than the first unit at a top end. The delay composition is shaped as a solid cylinder or a circular disc and is located within the fourth unit, at the top end.

An initiating composition, comprising for example a first layer 13 of lead or silver azide and a second layer 14 of hexogen or penthrite, is pressed with a high pressure, for example 20–100 MPa, on the second surface 10 and elements 11.

When the elements 11 reach their ignition temperatures, the initiating composition is ignited, that is the first layer 13 is ignited and the ignited layer 13 ignites the layer 14. Along its central portion, the silver or lead azide layer 13 is in high pressure contact with the delay composition 6. The units 1, 2, 7 and 8 and the pyrotechnical compositions are enclosed in a capsule or container 15. Inside the container, the layers 13 and 14 of the initiating composition are enclosed by a supporting part 16, which is in contact with one end of the unit 7. At its other end, the container 15 is provided with a cover 17 which rests against the other end of the unit 7 and which is provided with an aperture through it, like the supporting part 12. The rod-shaped unit 2 extends through apertures in the unit 8, the part 12 and the cover 17. The cover and the unit 2 are sealed against moisture with an electrically insulating coating 18 of glue or the like, which keeps all of the parts inside the electric igniter well protected from moisture. The high pressure for the compositions 6 and 13, 14 is achieved in a press and is maintained by folding the container 15 over the cover, in a way which is known in itself. The container 15 has an outer diameter of 6.5 millimeters.

The electric ignition cap forms a single-pole connection, the unit 2 being connected to a voltage source and the container 15 being connected to the material (grounded) of the projectile, shell, rocket or other body that is employed in, the electric ignition system.

The units 1, 2, 7 and 8 are connected in series and the elements 5 and 11 provide a number of paths for the current passing through the units. In the present case, the first element 5 is made so that it is sensitive; that is, it assumes an ignition temperature when there is a comparatively low capacitance voltage or other voltage. The second elements 11 are assumed to be comparatively insensitive or slow, and therefore, do not heat to their ignition temperatures until there is an applied capacitance or voltage which well exceeds the first capacitance voltage or other voltage.

When the capacitance voltage or other voltage of lesser magnitude is connected between the unit 2 and the container 15, there is an electric connection via the unit 2, the elements 5, the unit 1, the unit 8, the elements 11, the unit 7 and the container 15. When a particular relatively low power is supplied, the sensitive element 5 is heated to its ignition temperature, and the delay composition 6 is ignited and begins to burn gaslessly in its axial direction. When the delay composition 6 has burned to its furthest extent, the silver azide layer 13 and the hexogen or penthrite layer 14 are ignited, in the order mentioned. The first delay time between the connection of the electric power and the ignition of the initiating composition 13, 14, is determined substantially by the burning time of the delay composition 6, since the heating of the element 5 to its ignition temperature is assumed to take place very rapidly, and is negligible in this connection. It should be obvious that the electric ignition cap may be constructed to provide for different lengths for the delay composition, and corresponding different delay times, which can be chosen e.g. between 0.5 ms and several seconds, particularly between 0.5 and 5 ms. When the ignited charge 13, 14 is initiated, the container 15 bursts, and a detonation (or an ignition flash if a different type of initiating composition is used) is obtained which can be used to set off various kinds of main charges. In this case, the elements 11 are not heated to their ignition temperature.

The new electric ignition cap also permits a very rapid ignition of the initiating composition 13, 14. When a capacitance voltage or other voltage of greater magnitude is applied, the ignition temperature is reached very rapidly, not only by the element 5, but also by the element 11, thus the initiating composition is directly ignited by the elements 11 after a second initiating or delaying time that is only a few microseconds after the capacitance voltage or other voltage has been connected. In accordance with the invention the capacitance voltage or other voltage is of such a magnitude that the first element 5 maintains its conducting capability until the elements 11 have reached an ignition temperature and ignited the composition 13, 14.

Tests have shown that a good initiating function of the pyrotechnical composition can be obtained from the respective elements, and that a capacitance of $0.1\times10^{-6}$F utilized for the first element is activated at 100 V and the second elements at 200 V. At 200 V the first element maintains its conducting capability even though evaporation of the first element may have begun.

Figure 2:
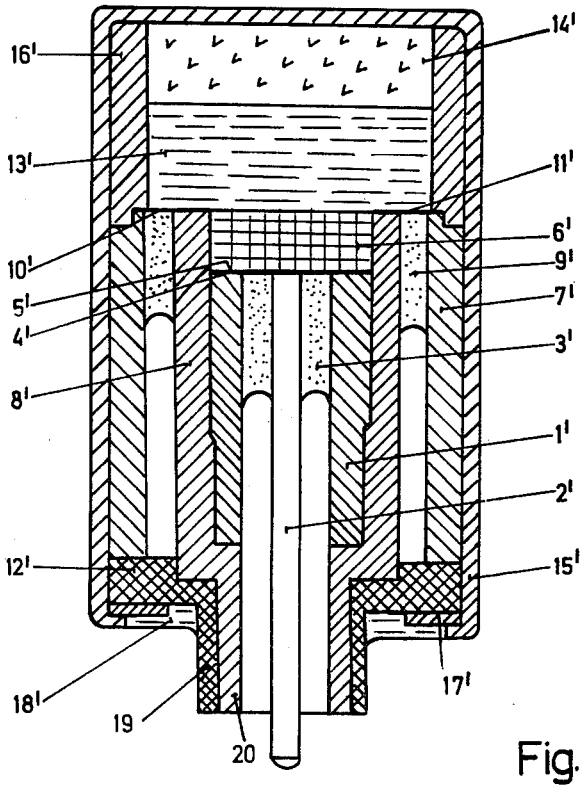
FIG. 2 in a vertical section shows the electric ignition cap in a second embodiment made for double-pole connection.

The electric ignition cap according to FIG. 2 is built up in general in the same way as the embodiment according to FIG. 1. However, the supporting part 12' and the unit 8' of FIG. 2 have each been provided with a neck-shaped part 19 and 20, respectively, arranged so that the unit 8' will be available for connection to one of the poles of the source of power that is utilized to ignite the cap. Thus, connection between the grounded container 15' and the unit 2' may be made as in the embodiment according to FIG. 1. Alternatively, a source of power may be connected either between the unit 2' and the unit 1', thereby energizing only the first element 5', or between the unit 1' and the container 15', thereby energizing the second elements 11. In the latter case, the elements 5 and 11 are made with the same high sensitivity, so that with the indicated connection, the delay composition and the initiating composition 13', 14' will be simultaneously ignited. Thus, the structure of FIG. 2 creates a double pole connection in which the first element(s) and the delay composition 6' create a first ignition circuit for the initiating composition, and the units 7 and 8 and the second element(s) create a second ignition circuit for the initiating composition.

Figure 3:
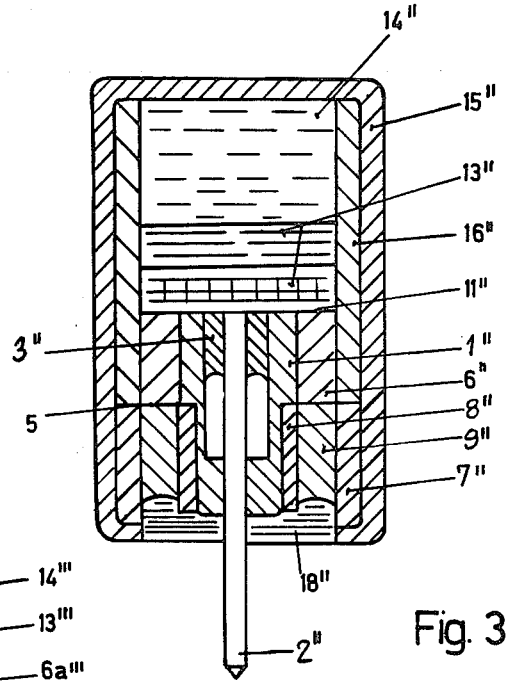
FIG. 3 in a vertical section shows the electric ignition cap in a third embodiment.

The embodiment according to FIG. 3 is particularly directed to the problem of achieving an electric ignition cap with extremely small external dimensions, particularly in the axial length of the cap. In this case, the units 1'' and 2'' and the body 3'' have been arranged inside units 7'' and 2'' and the body 9''. The unit 8'' is utilized as a connection to the single-pole electric ignition cap, which can have its outer capsule connected to the material of the shell in which the cap is used. Through this arrangement, the first delay composition 6'' is shaped in the form of a hollow cylinder that is placed outside the unit 1''. Thus, the cap of FIG. 2 has a smaller axial length than the cap of FIG. 1. Further, the units 1''0 and 8'' are galvanically contacting the unit 1'' having a lower half with a smaller diameter for engaging and supporting the unit 8''. Also the body 9'' has a comparatively shorter axial length while the supporting part 16'' is extended so that it can enclose the delay composition 6'' in addition to the pyrotechnical compositions 13'', 14''. With the construction thus obtained, the element 5'' (one or several) will be located below the element 11'' (one or several) instead of the other way around, just as in the embodiments previously described.

Figure 3A:
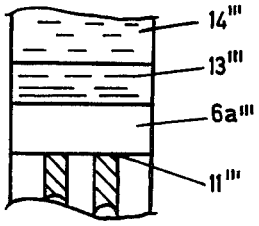
FIG. 3*a* in a vertical section shows the principle of the modifications of the parts in the embodiment according to FIG. 3.

In the examples described above, it has been assumed that the second element is to ignite the initiating composition directly. It is, of course, also possible to allow the second element to ignite the initiating composition via a second delay composition, which has been shown in principle in FIG. 3*a*, in which the second delay composition has been given the designation **6*a'''***. In FIG. 3*a*, for the sake of clearness, only the second element 11''' and the initiating composition 14''' with the silver azide layer 13''' have been shown. The compositions **6*a* and 6*a'''*** have, in principle, the same embodiment.

Figure 4:
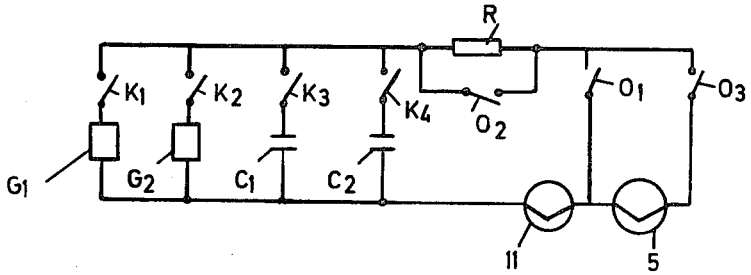
FIG. 4 schematically shows the electric circuits.

FIG. 4 is intended to show the electric circuit diagram for the different connection alternatives mentioned above. The capacitors $C_1$ and $C_2$ of different power and/or voltage sizes can be charged individually or together with electric generators $G_1$ and $G_2$, respectively, which are known in themselves, and which can be made to produce different voltages and power. The connection contacts for the generators and capacitors are shown by $K_1$–$K_4$ and switches for connecting the different connection circuits are shown by $O_1$–$O_3$. Through the actuation of said contacts and switches, the elements 5 and 11 can be connected to one or both capacitors, together or individually, directly or via a resistor R. Likewise, the capacitors can be charged from one generator each or together from one common generator. A projectile is usually not provided with all of these alternatives, but only one or two, for which the universal electric igniter is to function. For certain kinds of ammunition it may be advisable to provide the projectile or the like with the possibility of having alternative settings of the voltage level or connection in question. The projectile or the like is therefore provided with a manual setting means which in a first position gives a first level or circuit and in a second position gives a second level or circuit. Setting of the means can then be done for example, on the occasion when loading takes place. At the setting, the switches $O_1$–$O_3$ are actuated.

Figure 5A:
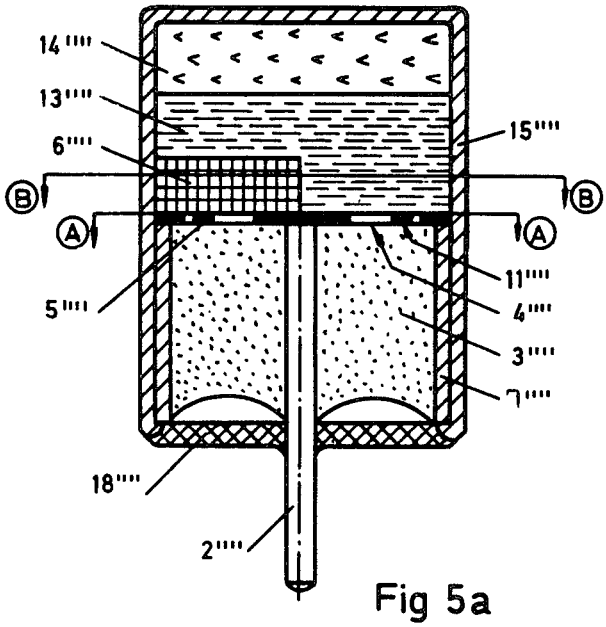
FIG. 5*a* shows in a vertical section.
Figure 5B:
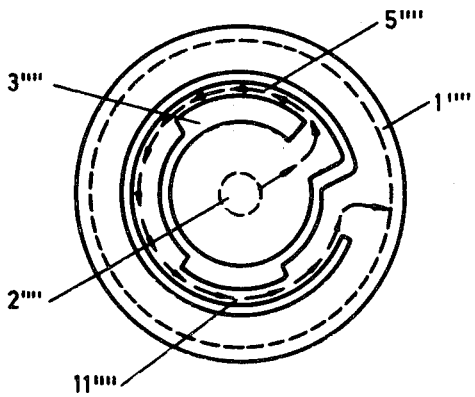
FIGS. 5*b* and 5*c* show in cross-sections the electric ignition cap in a fourth embodiment made for single-pole connection.
Figure 5C:
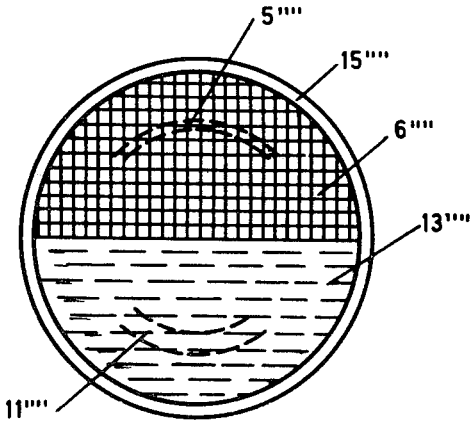

In FIGS. 5*a*–5*c* there is illustrated a fourth embodiment of the ignition or blasting cap. In this embodiment the first and second elements 5'''' and 11'''', respectively, are located in a common plane and are attached to the same surface 4'''' in the same way as described above. As shown in FIG. 5*b* there is only one first element 5'''' and one second element 11'''' that are formed by cutting a helical channel in the layers that are applied on the surface by vacuum evaporization. The channel is provided with opposite enlarged parts that define elongated arcuate first and second elements. The elements are indicated in FIG. 5*c* by dotted lines. The enlarged part at the first element 5'''' is more extended than the enlarged part at the second element 11'''' so that the first element is narrower than the second element and, therefore, is more responsive to a heating current that the second element.

In this case the pyrotechnical delay composition 6'''' has the shape of a solid semicylinder, which is pressed against the surface 4'''' and the first element 5''''. The initiating composition layer 13'''' is pressed partly against the delay composition 6'''' and partly against the second element 11'''' and the surface 4''''. The delay composition is comparatively short, as is the whole cap. The first and second elements are connected in series along a circle. One end of the two elements is connected to the unit 1'''' and the other end is connected to the unit 2''''. In FIG. 5*b* the current flow is indicated with arrows. The power level that is applied via units 1'''' and 2'''' determine whether the first or second element will be ignited and, hence, whether the composition 13'''' will be ignited directly or via the delay composition. Instead of two elements with one delay composition and two power levels, it is possible to utilize three different elements (in series) with two delay compositions and three power levels for providing three delay times. Additional elements, delay compositions and power levels may be utilized to provide additional delay times.

The invention is not limited to the embodiments shown above, but is subject to modifications within the scope of the following claims. Thus, it is possible, for instance, to provide an electric igniter having three or more different ignition times, by connecting additional units to the units 1, 2 and 7, 8, as well as additional surfaces and elements. Also the external dimensions may be varied, for example the cap may be made with a diameter as small as approximately 3 mm and a length of approximately 4 mm.

I claim:

1. Electric ignition apparatus for igniting a pyrotechnical ignition charge at particular time delays after a triggering voltage is applied, comprising:

at least one pyrotechnical delay charge for burning at a particular rate after being ignited and having dimensions defining a particular time delay;

ignition means for igniting said pyrotechnical delay charge in response to an applied voltage at least equal to a first triggering voltage level, said delay charge burning to ignite said pyrotechnical ignition charge in a delayed manner, and for igniting both said pyrotechnical ignition charge and said pyrotechnical delay charge in response to an applied voltage at least equal to a second triggering voltage level, said ignition means comprising:

a first unit of electrically conductive material, said first unit having a first end surface;

a second unit of electrically conductive material, said second unit having a second end surface and being disposed inside of said first unit;

a first insulating body disposed between said first and second units, said first insulating body having a third end surface;

a first heating element electrically connecting said first and second units, said first heating element being supported on said first, second and third end surfaces in contact with said pyrotechnical delay charge;

a third unit of electrically conductive material, said third unit having a fourth end surface;

a fourth unit of electrically conductive material, said fourth unit having a fifth end surface and being disposed inside said third unit, said fourth unit also being disposed around and electrically connected to said first unit;

a second insulating body disposed between said third and fourth units, said second insulating body having a sixth end surface; and a second heating element electrically connecting said third and fourth units, said second heating element being supported on said fourth, fifth and sixth end surfaces in contact with said ignition charge.

2. The apparatus of claim 1 including means for pressing at least a portion of said ignition charge against said second heating element and said fourth, fifth and sixth end surfaces.

3. The apparatus of claim 1 wherein said end surface of said fourth unit extends beyond said end surface of said first unit to define a space for supporting said delay charge adjacent said first heating element and said first, second and third end surfaces.

4. The apparatus of claim 1, further comprising a second delay charge and means for pressing said second delay charge in contact with said second heating element and at least a portion of said ignition charge.

5. The apparatus of claim 1 wherein said ignition charge comprises a first layer of silver or lead azide disposed for initial ignition and a second layer of hexogen or penthrite which is ignited by the ignited first layer.

6. The apparatus of claim 1, including an electrically conducting container for enclosing said first, third and fourth units and a portion of said second unit, and for electrically contacting said third unit, and a voltage source means connected between said second unit and said container for applying said first voltage level to heat said first heating element to an ignition temperature and for applying said second voltage level to heat said second heating element to an ignition temperature.

7. The apparatus of claim 1 wherein said first and fourth units are galvanically connected.

8. Electric ignition apparatus for igniting a pyrotechnical ignition charge at particular time delays corresponding to input triggering voltages, comprising:

electrically conducting container means for containing said ignition charge and for defining a closed ignition area;

first support means having a first, outer electrically conducting shell unit and a second, inner electrically conducting shell unit, positioned in insulated, spaced relation within said first, outer shell unit, said first, outer shell unit contacting said container means;

second support means disposed inside at least a portion of said second, inner shell unit, said second support means having a second, outer electrically conducting shell unit and an inner electrically conducting electrode unit positioned in an insulated, spaced relation within said second, outer shell unit and extending outside said container means; said second, outer shell unit being electrically connected to said second, inner shell unit of said first support means;

first heating element means electrically connecting said electrode unit and said second, outer shell unit, said first heating element means being dimensioned to heat to an ignition temperature in response to at least a first input triggering voltage applied to said electrode unit;

second heating element means electrically connecting said second, inner shell unit and said first, outer shell unit, said second heating element means being dimensioned to heat to an ignition temperature in response to at least a second input triggering voltage applied to said electrode unit;

at least one pyrotechnical delay charge for burning at a particular rate after being ignited and having dimensions defining a particular time delay;

means for pressing said at least one pyrotechnical delay charge into contact with one of said heating element means and at least a portion of said ignition charge, said delay charge thereby being ignited when said one heating element means is heated to an ignition temperature, the ignited delay charge burning to ignite the ignition charge after at least a time delay defined by the dimensions of the delay charge; said means for pressing also pressing at least a portion of said ignition charge into contact with the other one of said heating element means, said ignition charge thereby being ignited after said other one of said heating element means is heated to an ignition temperature.

9. The apparatus of claims 1, 2, 3, 4, 5, 6 or 8 wherein said units of electrically conductive material are coaxial.

* * * * *